US005081857A

United States Patent [19]

Matsui et al.

[11] Patent Number: 5,081,857

[45] Date of Patent: Jan. 21, 1992

[54] COLD ROLLING METHOD USING CLEANING BRUSHES FOR AT LEAST THE BACK UP ROLLS

[75] Inventors: Naoki Matsui; Shuichi Iwato; Shuji Kaneto; Takami Kubo; Masayuki Yamazaki; Shigeru Moriyama, all of Kawasaki, Japan

[73] Assignee: NKK Corporation, Tokyo, Japan

[21] Appl. No.: 488,329

[22] Filed: Mar. 5, 1990

[30] Foreign Application Priority Data

Apr. 28, 1989 [JP] Japan ..... 1-107347
Apr. 28, 1989 [JP] Japan ..... 1-107348
Apr. 28, 1989 [JP] Japan ..... 1-107349

[51] Int. Cl.[5] ..... B21B 28/04; B21B 37/00

[52] U.S. Cl. ..... 72/6; 72/236; 15/256.52; 100/174

[58] Field of Search ..... 72/236, 6, 39, 40; 15/256.52, 308; 100/155 R, 160, 174; 355/301, 304

[56] References Cited

U.S. PATENT DOCUMENTS 2,953,952 9/1960 Alexander ..... 72/236

FOREIGN PATENT DOCUMENTS 0107514 5/1984 European Pat. Off. ..... 355/301
0101074 7/1979 Japan .
0011480 2/1981 Japan ..... 355/301
0075203 5/1982 Japan ..... 72/236
0075212 5/1982 Japan ..... 72/236
0081207 4/1987 Japan ..... 72/236
57-75212 4/1989 Japan .
54-101074 4/1989 Japan .

OTHER PUBLICATIONS

IBM Technical Disclosure Bulletin, Harmon et al., "Cleaning Brushes that Prevent Clear Film Streaking", Oct. 1972, vol. 15, No. 5, p. 1434.

*Primary Examiner*—Lowell A. Larson
*Assistant Examiner*—Thomas C. Schoeffler
*Attorney, Agent, or Firm*—Frishauf, Holtz, Goodman & Woodward

[57] ABSTRACT

A method for cold rolling a strip is wherein brushing roll are provided to both the work rolls and the back up rolls of the temper mill, to remove particles from the surface of the rolls of the mill and suction ducts adjacent to the brushing rolls transport the foreign objects out of the mill system. The sucking speed at the duct is at least 5 m/sec., and preferably 8 m/sec. The length of the bristle is from 15 to 60 mm, the diameter thereof being from 0.15 mm to 1.0 mm, and the material thereof is selected from a group of nylon, propyrene, or a the mixture thereof. The density of the bristle with respect to the peripheral surface area of the brushing rolls for the work roll is from 55 to 85% by area. Abrasive grains with a grain size of #300 to #1200 are incorporated in the brush of said brushing roll which enhance the brushing ability.

The material of the abrasive grain includes at least one selected from a group of alumina, titania, and silicate, and the volume percentage of the grain with respect to the volume of the brush is from 5 to 30% in volume.

9 Claims, 7 Drawing Sheets

COLD ROLLING METHOD USING CLEANING BRUSHES FOR AT LEAST THE BACK UP ROLLS

BACKGROUND OF THE INVENTION

1. Field of the invention

This invention relates to the field of the cold rolling of strip, and particularly to the field of the cold rolling of steel strip by temper mills.

2. Description of the prior art

When metal strips are rolled by temper mills, the cleaning of the surface of the rolls is required to maintain the surface quality of the strip products and to avoid defects associated with the rolling. One of the cleaning methods is the constant removal of the foreign objects on the surface of the rolls by various means of brushing.

Japanese Patent Publication laid open No. 57-75212 discloses a method wherein brushing rolls are used for loosening particles from the surface of the work rolls, and exhausting means are used to remove the objects from the rolling system. However, in this disclosed invention, the removal is limited to the foreign objects on the surface of the work rolls. Accordingly, the complete removal of the objects is not attained because foreign objects on the surface of the back up rolls may contaminate the surface of the strip. To produce a strip with a matte surface, the surface of the work rolls has comparatively large roughness of surface, and the hardness of the surface of the back up rolls is lower than that of the work roll, which causes the generation of abrasive powders from the contact of the work roll with the back up roll. The contact pressure between the work roll and back up roll is higher than that between the work roll and the strip, which causes the generation of the abrasive powders. Moreover, when the mill is driven by work roll, or top or bottom back up roll, the contact surface between the rolls slips, which causes the generation of the abrasive powders. This necessitates the constant removal of the foreign objects on the surface of the work roll and the back up roll to prevent contamination and resultant surface defects of the strip.

This prior art method has the problem that the brushing ability or the suction of the exhausting means can deteriorate; also exhausting ducts may contact the brushing rolls when the diameter of the brushed roll or the diameter of the brushing roll are changed. Another problem in the prior art method is that of scratch marks on the surface of the rolls, caused by the bristles of the brushing rolls. When the rolls of the mill are stopped one roll may continue to rotate while another roll has stopped. Another problem is the positioning of the brushing rolls when the rolls of the mill are changed and the brushing device includes exhaust duct which move forward or backward. In this situation the positioning of the new brushing rolls must be adjusted to work with the brushing rolls and the exhaust system.

Japanese Utility Model Publication laid open No. 54-101074 discloses a method wherein air blowing holes are attached to the brushing roll to prevent the generation of heat by the friction between the brushing roll and the brushed roll. However the density of the bristle is unevenly distributed, which causes a brushing pattern on the surface of the rolls of the mill, which is printed on the strip surface as unevenly distributed roughness.

Japanese Patent Publication laid open No. 57-75212 discloses a method wherein an abrasive grain is incorporated in the brush of the brushing roll to assist in removing foreign objects and to increase the rigidity of the bristle.

However these measures in turn can cause defects on the surface of the rolls of the mill.

SUMMERY OF THE INVENTION

It is an object of the present invention to provide a cold strip rolling method.

It is another object of the present invention to provide a cold strip rolling method, wherein foreign objects on the surface of the rolls are effectively removed, and carried away from the mills.

According to the invention a cold strip rolling method comprises the steps of contacting a plurality of brush rolls with the rolls of the mill, the directions of rotation thereof being reverse to or the same direction as that of said back up rolls or said work rolls and then sucking out air into ducts in the neighbourhood of said brush rolls.

The speed of the flow of said sucking is at least 5 m/sec, and preferably 8 m/sec. The ducts and said brushing rolls are moved, independently or in unison, by access and recess mechanisms in view of the relative position thereof to the rolls of the mill, wherein the brushing pressure of the brushing rolls on the rolls of the mill and the rate of flow of said sucking is regulated, and the brushing rolls are recessed when the mill is shut down, or the recess and access of the brushing rolls are excecuted in case of the change of the rolls of the mill. The material of the bristle of brushing rolls is selected from a group of nylon, propyrene, and the mixture thereof. The diameter of the bristle of said brushing rolls for the work rolls is from 0.2 mm to 0.8 mm, for the rolls of the mill and the length of the bristle is from 15 to 60 mm.

The density of the bristle with respect to the peripheral surface area of the brushing rolls for the work rolls is from 55 to 85% by area. Abrasive grains with the grain size of from #300 to #1200 are incorporated in the brush of the brushing roll. The volume percentage of the abrasive grain with respect to the volume of brush is from 5 to 30% in volume. The abrasive grain wherein the material is one or more selected from a group of alumina, titania, and silicate.

DESCRIPTION OF THE PREFERRED EMBODIMENT

Figure 1:
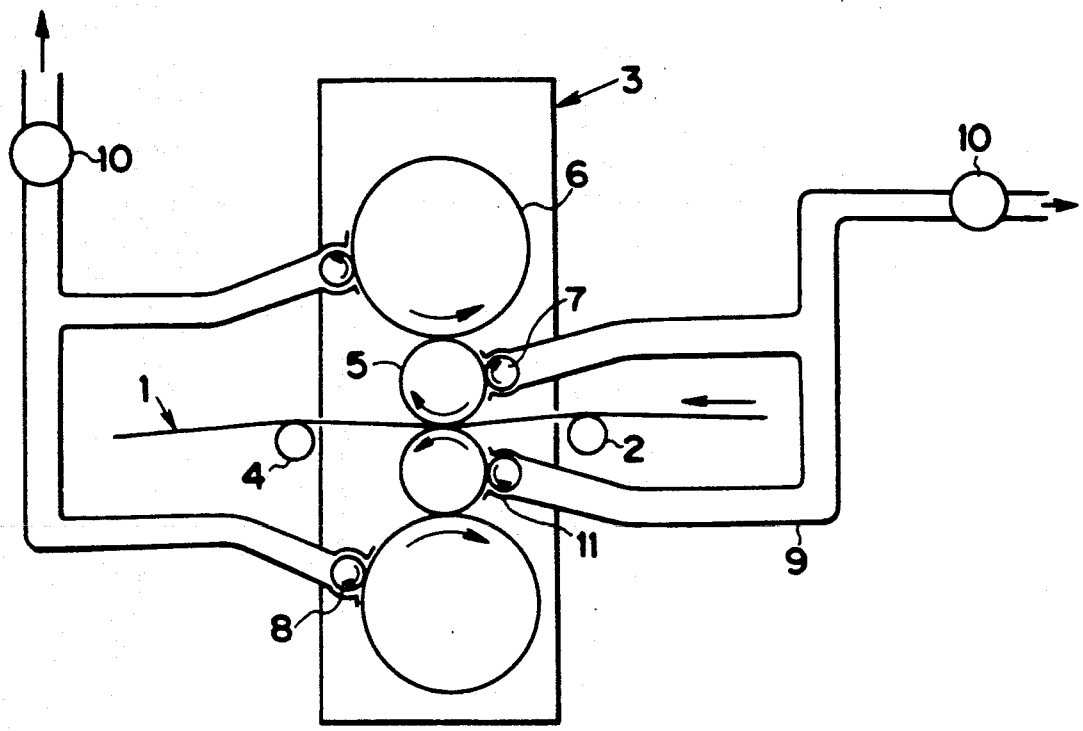
FIG. 1 is a schematic side view of the apparatus in use of an embodiment of the present invention.

In temper rolling of the strip, the finished strip is a final product.

Therefore, utmost care should be taken to prevent contamination, which will results in defects of the strip surface. To avoid the above mentioned problem, it is necessary to completely remove foreign objects on the surface of the back up roll and more preferably on the work roll and back up roll of the mill by at least one brushing roll which contacts at least one roll of the mill. This brushing roll can rotate in the same or preferably in the reverse direction to that of the rolls of the mill. A plurarity of exhaust ducts are attached close to the brushing rolls. Thus the foreign objects are removed from the surface of the rolls of the mill, and carried away through the exhaust ducts.

In this removal apparatus, the distance between the brushing roll and the rolls of the mill, and the distance between the duct and the rolls of the mill should be changed by a moving mechanism which moves the duct and/or the brushing rolls foreward and backward. The purposes of these movements is to adjust: the contact pressure of the brushing rolls on the rolls of the mills, the suction at the ducts, and the position of the brushing rolls and the ducts, when changing the rolls of the mill. The suction speed of the air at between the ducts and the rolls of the mill should be at least 5 m/sec., and preferably 8 m/sec., to carry the removed foreign objects out of the mill.

Concerning the bristle of the brushing roll, the material should be nylon, polypropyrene or the mixture thereof, the diameter thereof is 0.15 to 1.0 mm, and preferably 0.2 to 0.8 mm the length thereof is 15 to 60 mm, the density thereof is 55 to 85% by area percentage of the surface of the polishing roll.

To promote efficiency of brushing, abrasive grains of grain size #300 to #1200, are used; the grain material is selected from alumina, titania, and silicate, or a combination thereof; the volume of these grains to the volume of the brush is 5 to 30%. The reason for specifying the various ranges explained above is as follows.

1. The reason of attaching the brushing roll on the back up roll and more preferrably on the work roll and the back up roll is that the attachment of the brushing roll on the work roll is not enough to remove the foreign objects on the surface of the roll. The reason that the direction of the rotation of the polishing roll is reverse to that of the roll of the mill is that the foreign objects on the surface of the roll of the mill may not be completely removed, by rotating the polishing roll in the same rotational direction of the roll of the mill. However the direction of the rotation may be the same with that of the roll of the mill, depending on the brushing condition.

2. When the material of the bristle is hard such as metal, the bristle causes scratch marks on the surface of the roll of the mill, and the brushing ability is considerably lowered by the bending of th tip of the bristle. When the material of the bristle is soft, no polishing effect is expected.

Accordingly, the materials of nylon, polypropyrene, or the mixture thereof are selected.

3. When the diameter of the bristle is below 0.15 mm, no brushing effect is expected. When the diameter is above 1.0 mm, the roll of the mill will be worn by the excessive brushing effect. Accordingly, the diameter of the bristle should be 0.15 to 1.0 mm, and preferrably 0.2 to 0.8 mm.

4. When the length of the bristle is below 15 mm, the bent bristle can not recover to be straight, which causes the reduction of the brushing ability. When the length of the bristle is above 60 mm, the rigidity of the bristle is reduced, which causes reduction of brushing ability. Accordingly, the length of the bristle is determined to be 15 to 60 mm.

5. When the density of the bristle is below 55% by area percentage of the surface of the brushing roll, the surface of the roll of the mill is unevenly brushed, which causes a brushing pattern on the surface. When the density of the bristle is above 80% by area percentage of the surface of the brushing roll, the bristle does not recover to be straight after brushing.

Accordingly, the density of the bristle should be 55 to 80% by area percentage of the surface of the brushing roll.

6. The incorporation of the abrasive grain in the brushing roll is an effective way to enhance the brushing ability.

When the grain size is above #1200, the brushing ability is not sufficient. When the grain size is below #300, the brushing ability is excessive, which causes scratch marks on the surface of the roll of the mill. Accordingly, the grain size of the abrasive grain is determined to be #300 to #1200, more preferably, #100 to #1200 for the work roll and #500 to #1000 to the back up roll.

7. The material of the abrasive grain is one or more selected from alumina, titania, silicate, and their compounds in consideration of their polishing effect.

8. When the volume ratio of the abrasive grain by the volume of the brush is below 5%, the brushing ability is not sufficient. When the volume ratio of the abrasive grain by the volume of the brush is above 30%, the strength of the bristle decreased and the brushing ability is saturated. Accordingly, the volume ratio by the volume of the brush is determined to be 5 to 30%.

9. The suction speed of the air between the ducts and the rolls of the mill should be at least 5 m/sec., and preferably at least 8 m/sec., to carry the removed foreign objects out of the mill.

10. The distance between the duct and the rolls of the mill and the opening size of the ducts influence the suction. Thus adjustment of the distance and the opening size are required.

EXAMPLES

FIG. 1 is a schematic side view of the apparatus in use of an embodiment of the present invention. The metal strip 1 is uncoiled, travels through the deflector roll 2, rolled by the temper mill 3, travels through the deflector roll 4, and is coiled by a tension reel (not shown).

Figure 2:
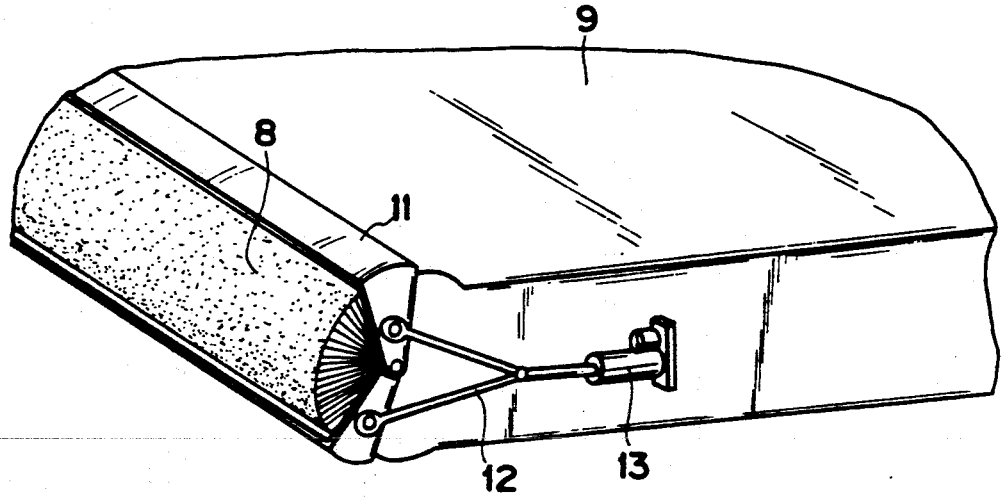
FIG. 2 is a detailed schematic perspective illustration of the duct 9 in the neighbourhood of the rolls of the mill.

The temper mill is a four-high mill comprising the work rolls 5 and the back up rolls 6. The brushing rolls 7 and 8 remove the foreign objects on the surface of the work rolls and the back up rolls. The brushing rolls 7 are attached to the entry side of the work rolls 5, whereas the brushing rolls 8 are attached to the delivery side of the back up rolls 6. To transport the foreign objects, the ducts 9 which incorporate the brushing rolls 7 and 8, are attached in the neighbourhood of the work rolls 5 and the back up rolls 6, of which one end is engaged with the hood 11, of which other end is connected to the blower 10, so that the foreign objects are carried away from the rolling system. FIG. 2 is a detailed schematic perspective illustration of the duct 9 in the neighbourhood of the rolls of the mill. The brushing roll 8 is incorporated in the duct 9.

The hood 11 is attached to the opening of the duct 9, the area of opening of the hood 11 being changed by the link mechanism 12 driven by the hydraulic cylinder 13. The area of opening has a close relationship with aforementioned suction. Therefore, the degree of the opening should be changed according to the diameter, and the relative position of the work rolls and back up rolls since the suction speed is influenced by these factors.

Figure 3:
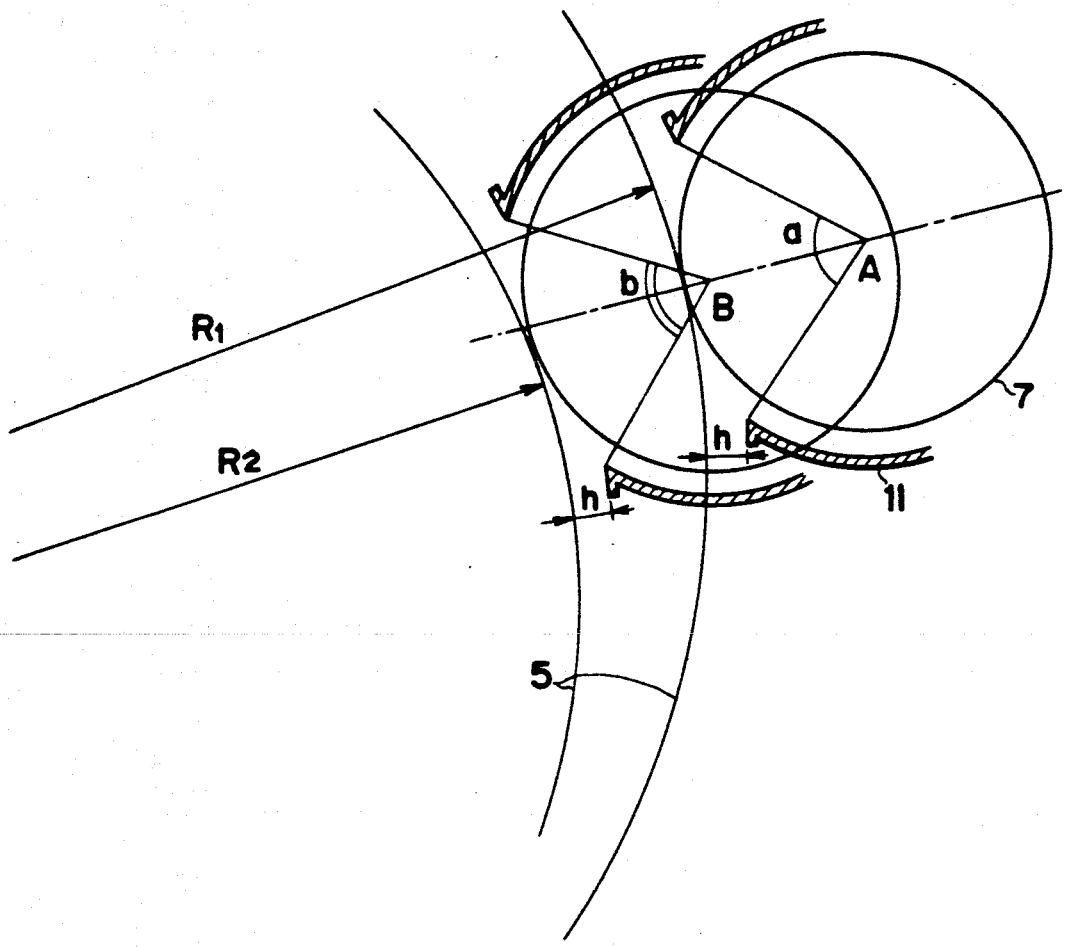
FIG. 3 is a schematic illustration of the relative position of the work roll, the hood, and the brushing roll.

FIG. 3 is a schematic illusration of the relative position of the work roll, the hood, and the brushing roll. The diameters of the work roll and the brushing roll are to be changed by the re-polishing thereof, and the position of the brushing roll relative to the work roll and the opening of the hood should be changed according to the change of the diameters of the work roll 5 to maintain the suction speed constant.

As shown in FIG. 3, by the change of the radius of the work roll from $R_1$ to $R_2$, the center of the polishing roll should be changed from point A to point B, and the degree of the opening of the hood should be changed from a to b to maintain the distance between the surface of the work roll and the tip of the hood, denoted as h, constant. This method is also applicable to the back up roll.

Figure 4:
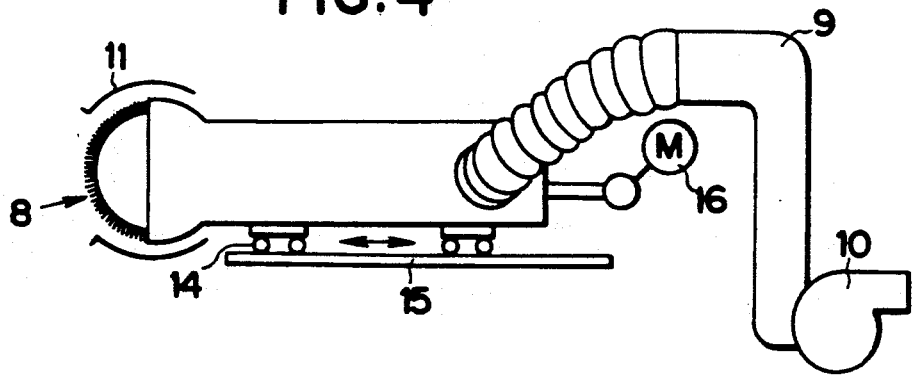
FIG. 4 is a schematic side view of a mechanism of moving the duct.

FIG. 4 is a schematic side view of a mechanism of moving the duct. As shown in FIG. 4, the brushing roll is incorporated in the moving part of the duct 9 flexibly connected to the main part of the duct. The duct is mounted on the carrier 14 which is driven by the motor 16 on the rail 15.

Figure 5:
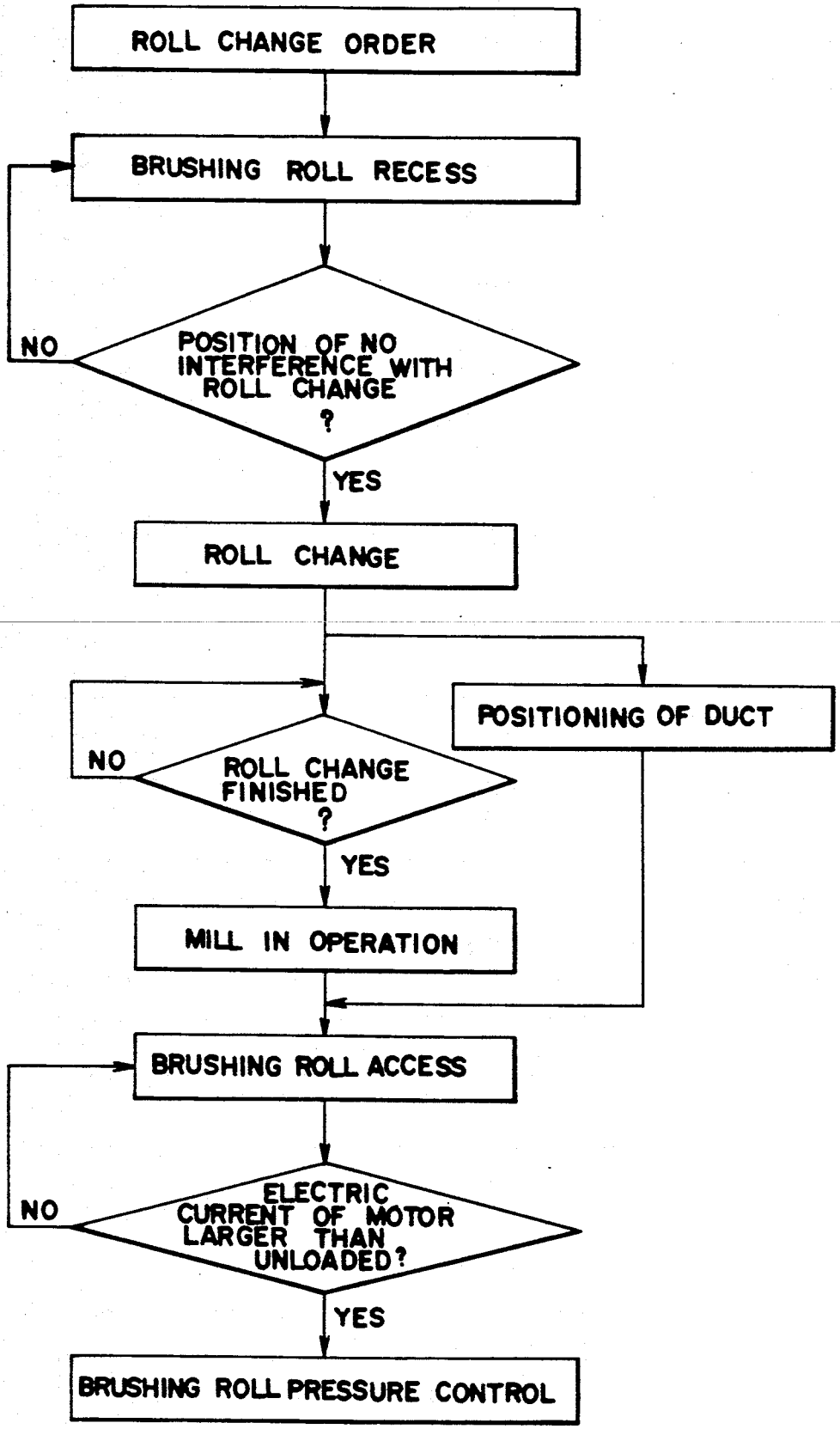
FIGS. 5 and 6 are flow charts which automatically change the position of the brushing rolls and the opening of the duct, in mill operation, roll changing, and mill stop.
Figure 6:
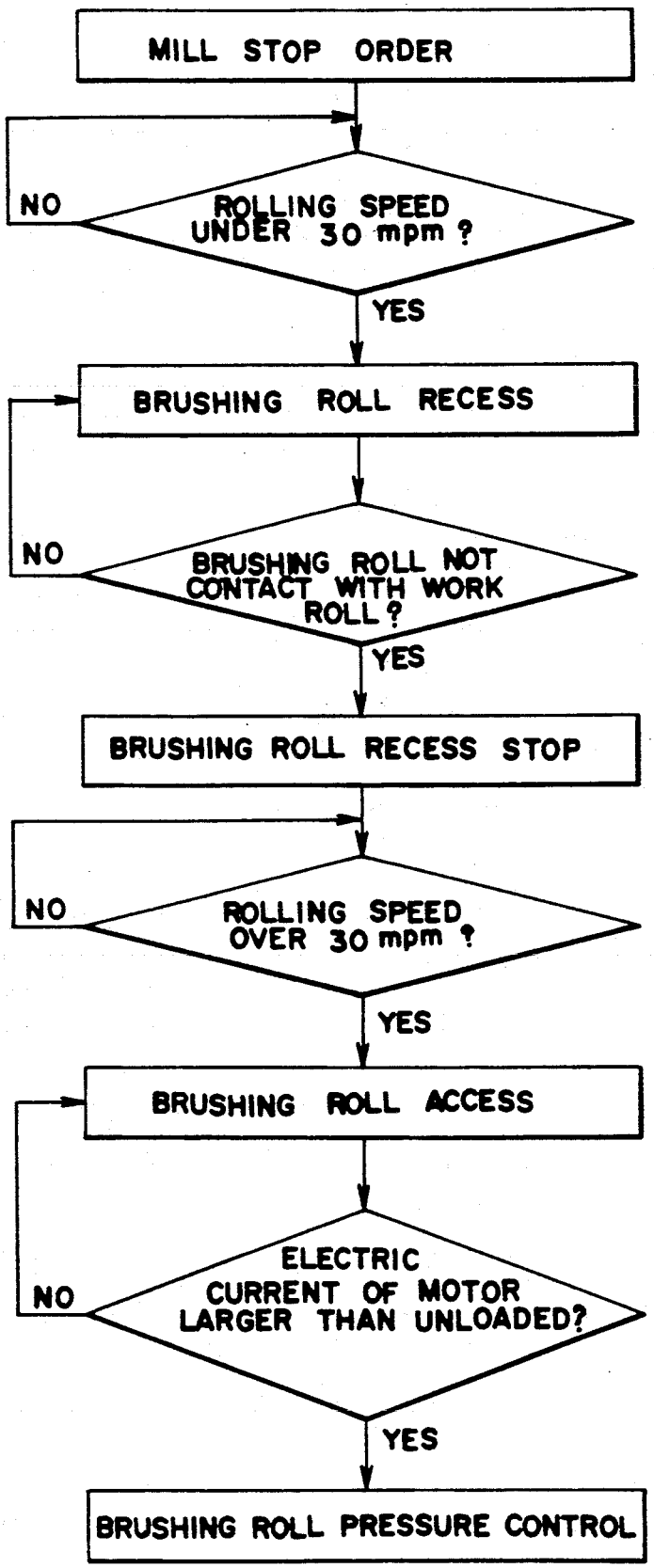

FIGS. 5 and 6 are flow charts which automatically change the position of the brushing rolls and the opening of the duct, during mill operation, when changing rolls, and when the mill stops. FIG. 5 is a flow chart showing the control logics in the series of operations from the roll changing to up. FIG. 6 is a flow chart showing the control logic in the series of operations from the mill stop to start up. As is shown in FIG. 5, when an operator orders the work roll changing, the brushing roll recesses to the position where the brushing roll does not interfere with the roll changing operation. The brushing roll accesses and contacts the work roll when a signal indicates that roll changing is finished, adjusting the position of the duct is adjusted according to the information regarding the diameter of the changed rolls. The opening of the hood is also adjusted. The brushing roll is pressed to the work roll until the electric current of the motor for the brushing roll reaches a predetermined value. The position of the duct is also adjusted when changing the back up roll or when changing the work roll and back up roll, and when there is a change of the vertical position of the rolls of the mill when using shims. The same positioning method can be applied to the alteration of the diameter of the brushing roll.

Moreover, the predetermined value of the electric current is changeable according to the diameter of the brushing roll.

As shown in FIG. 6, when an operator orders the mill to be stopped the brushing roll recedes to the position where the brushing roll does not touch the work rolls. When the mill restarts and the peripheral speed of the work roll reaches 30 mpm, the brushing roll approaches and contacts the work roll, and is pressed to the work roll until the electric current of the motor for the brushing roll reaches a predetermined value.

Figure 7:
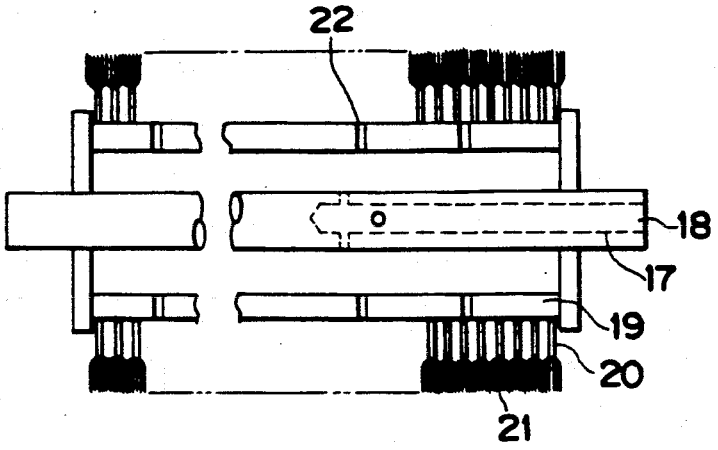
FIG. 7 is a schematic perspective illustration showing the assembly of the brushing roll.

FIG. 7 is a schematic perspective illustration showing the assembly of the brushing roll. The shaft of the brushing roll 17 is equipped with air supply tunnel 18. The outer cylinder 19 is fixed to the shaft 17, which is equipped with the holes 22 for flowing out of the air. The discs 20 are fixed to the outer cylinder 16, on top of which bristle 21 is imbedded. This structure is the result of the consideration of the even distribution of the density of the bristle.

Figure 8:
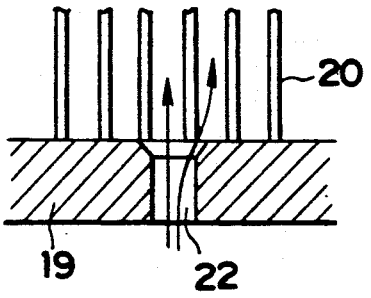
FIG. 8 is the enlarged view of the structure of the brushing roll shown in FIG. 7.

FIG. 8 is the enlarged view of the structure of the brushing roll shown in FIG. 7.

Consideration is given to the uniform air flow to the outer surface of the bristle 21 by adopting the diameter of the holes 22 larger than the thickness of the disc 20.

ROLLING TEST EXAMPLE 1

Rolling tests are carried out to verify the validity of the scope of the present invention. The condition of the test 1 is as follows:

(i) work roll,
material; forged steel,
hardness; Hs 92.,
surface roughness; 2.0 to 2.2 $\mu R_a$.
(ii) back up roll,
material; cast iron,
hardness; Hs 68.,
surface roughness; 0.08 to 0.1 $\mu R_a$.
(iii) brushing roll,
for work roll,
material; nylon,
diameter; 170 mm,
number of revolution; 350 rpm,
for back up roll,
material; nylon,
diameter; 260 mm,
number of revolution; 400 rpm,
abrasive grain; incorporated,
(iv) suction speed,
4, 6, 8, 10, m/sec.,
(v) rolled material,
as annealed cold reduced steel strip,
(vi) rolling method,
dry tempering.

Table 1 reports the result of the comparison between the conventional method and the method of the present invention.

As is shown in Table 1, the substantial rejection is found in the finished product irrespective of the suction speed in case of the conventional method, the work roll brushing, whereas the rejection ratio is below 4% with suction speed of more than 5 m/sec. and the rejection ratio is zero with suction speed of more than 10 m/sec in case of the present invention wherein the back up roll, or the work roll and back up roll is brushed.

Figure 9:
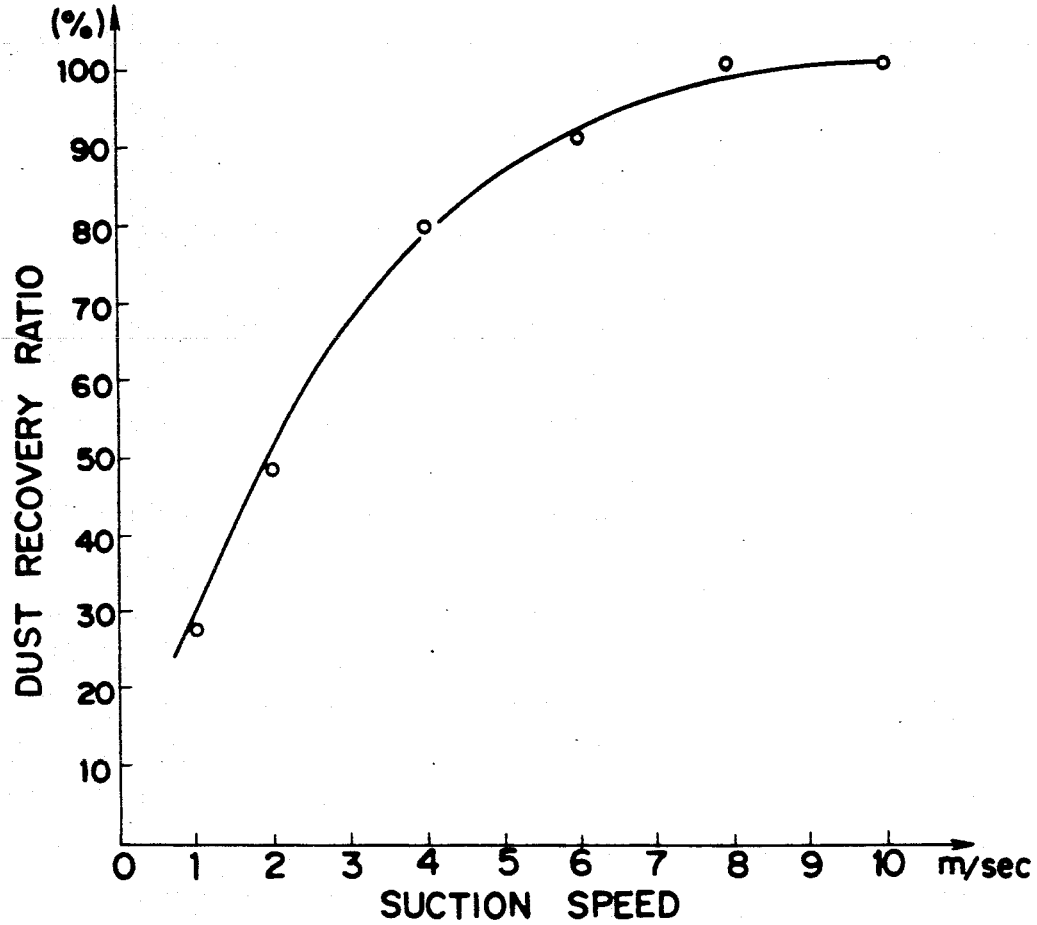
FIG. 9 is a graph showing the relationship between the suction speed and the dust recovery ratio.

FIG. 9 is a graph showing the relationship between the suction speed and the dust recovery ratio. The abscissa denotes the suction speed and the ordinate denotes the dust recovery ratio. As shown in FIG. 9, the dust recovery ratio of more than 80% is attained with the suction speed of more than 5 m/sec.

TABLE 1

| | WR | WR + BUR | BUR |
|---|---|---|---|
| Sucking Speed (m/sec.) | Rejection Ratio (%) | | |
| 4 | 10 | 5 | 7 |
| 6 | 6 | 2 | 4 |
| 8 | 4 | 0 | 2 |
| 10 | 3 | 0 | 0 |

WR; work roll
BUR; back up roll

ROLLING TEST EXAMPLE 2

The condition of the test 2 is as follows:

(i) work roll,
material; forged steel,
hardness; Hs 92.,
surface roughness; 2.0 to 2.2 $\mu R_a$.

(ii) back up roll,
material; cast iron,
hardness; Hs 68.,
surface roughness; 0.08 to 0.1 $\mu R_a$.

(iii) brushing roll,
for work roll,
diameter; 170 mm,
number of revolution; 350 rpm,
for back up roll,
diameter; 260 mm,
number of revolution; 400 rpm, (iv) suction speed,
10 m/sec., (v) rolled material,
as annealed cold reduced steel strip, (vi) rolling method,
dry tempering.

Table 2 reports the test results of the temper rolling with various condition of the bristle and the abrasive grain. As shown in Table 2, in the cases of comparison wherein the rolling condition is out of the scope of the invention, rejections are reported as for the quality of the finished products, whereas in the cases of the present invention, no rejections are reported. The rejections are reported in the condition of the diameters of the bristle in case of the comparison example 7 and 8, the density of the bristle in 9, the grain size of the abrasive grain of the work roll in 10, the diameter, the density of the bristle of the work roll, and the grain size of the abrasive grain of the work roll in 11, the material of the bristle, the diameter, and the grain size of the abrasive grain of the work roll in 12.

TABLE 2

| | | Brashing Condition | | | | | |
|---|---|---|---|---|---|---|---|
| | | Material | Dia. of Bristle (mm) | Density of Bristle at WR (%) | Grain Size of Powder at WR (#) | Grain Size of Powder at BUR (#) | Rejection Ratio (%) |
| Examples of Invention | 1 | Nylon | 0.3 | 85 | 1000 | 500 | 0 |
| | 2 | Nylon | 0.3 | 60 | 1000 | 500 | 0 |
| | 3 | Nylon | 0.5 | 85 | without | 500 | 0 |
| | 4 | Nylon | 0.5 | 60 | without | 500 | 0 |
| | 5 | Nylon | 0.8 | 80 | without | 1000 | 0 |
| | 6 | Nylon | 0.8 | 70 | without | 1000 | 0 |
| Examples of Comparison | 7 | Nylon | 0.9 | 85 | without | 500 | 3 |
| | 8 | Nylon | 0.9 | 80 | without | 1000 | 2 |
| | 9 | Nylon | 0.5 | 50 | without | 500 | 1.5 |
| | 10 | Nylon | 0.3 | 60 | 500 | 500 | 1 |
| | 11 | Nylon | 0.15 | 50 | 500 | 500 | 3 |
| | 12 | Stainless steel | 0.15 | 70 | without | without | 10 |

WR; work roll, BUR; back up roll,

ROLLING TEST EXAMPLE 3

The condition of the test 3 is as follows:

(i) work roll,
material; forged steel,
hardness; Hs 92.,
surface roughness; 2.0 to 2.2 $\mu R_a$.

(ii) back up roll,
material; cast iron,
hardness; Hs 68.,
surface roughness; 0.08 to 0.1 $\mu R_a$.

(iii) brushing roll,
for work roll,
material of bristle; nylon,
diameter of bristle; 0.6 mm,
length of bristle; 45 mm,
material of abrasive grain; alumina,
grain size of abrasive grain; #600,
volume ratio of abrasive grain; 20% in volume of the brush,
diameter; 170 mm,
number of revolution; 350 rpm,
suction speed; 8.5 m/sec.,
for back up roll,
material of bristle; nylon 60%+polypropyrene 40%,
diameter of bristle; 0.5 mm,
length of bristle; 50 mm,
material of abrasive grain; alumina,
grain size of abrasive grain; #800,
volume ratio of abrasive grain; 10% in volume of the brush,
diameter; 260 mm,
number of revolution; 400 rpm,
suction speed; 8.0 m/sec., (iv) rolled material,
as annealed cold reduced steel strip, (v) rolling method,
dry tempering.

Figure 10:
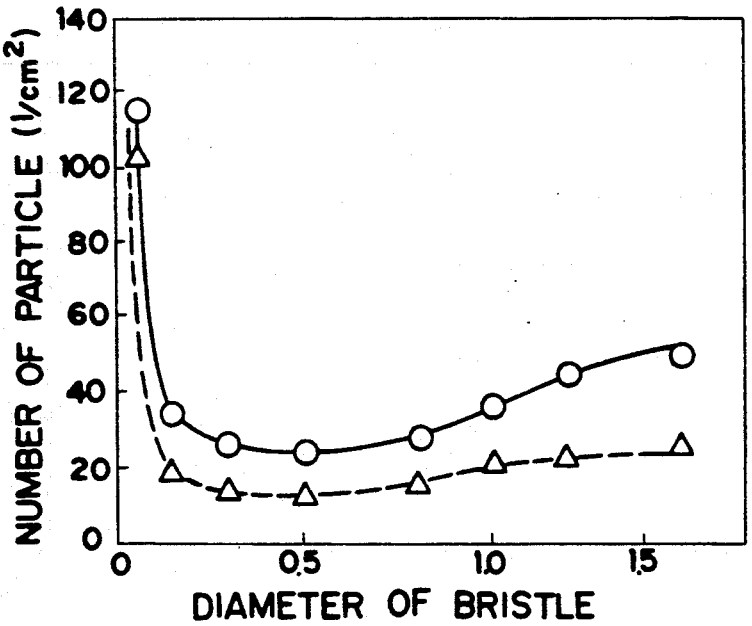
FIGS. 10 and 11 are graphs showing the relationship between the diameter of the bristle and the number or the volume of the iron particle per unit area of the surface of the roll of the mill.
Figure 11:
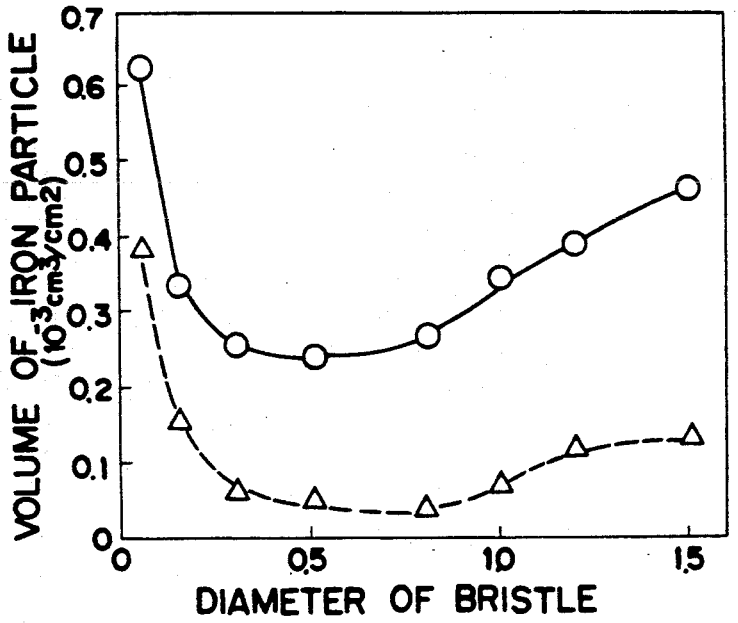

FIGS. 10 and 11 are graphs showing the relationship between the diameter of the bristle and the number or the volume of the iron particle per unit area of the surface of the roll of the mill.

The abscissa denotes the diameter of the bristle and the ordinate denotes the number or the volume of the iron particles per unit area of the surface of the roll of the mill. The triangular mark denotes the data of the present invention, and the circular mark denotes the data wherein the rolling is done without applying the abrasive grain to the brush. As is shown in FIGS. 10 and 11, the diameter of the bristle is preferrable in the range of from 0.15 to 1.0 mm, more preferable in the range of from 0.2 to 0.8 mm. The application of the abrasive grain to the brush is effective to remove the foreign objects. However, when the grain size of the abrasive grain is below #300, the polishing effect to the roll of the mill is too much, which results in the generation of scratch mark on the surface of the roll of the mill. When the grain size is above #1200, the brushing effect is not sufficient.

Figure 12:
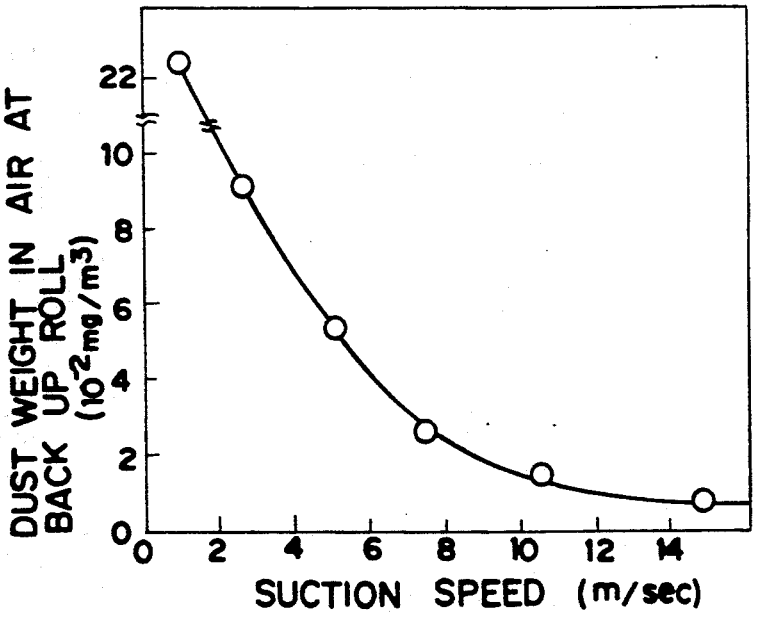
FIG. 12 is a graph showing the relationship between the suction speed and the quantity of dust in the air at the back up roll.

FIG. 12 is a graph showing the relationship between the suction speed and the quantity of dust in the air at the back up roll. As shown in FIG. 12, the dust per unit volume of air; $2\times10^{-2}$ mg/m$^3$ is about the same with that of the ambient atmospheric air, with the suction speed of at least 8 m/sec.

The length of the bristle influences on the rigidity of the bristle and the brushing effect. When the length is too large, the bristle loses the rigidity which causes the worsening of the brushing effect, whereas the appropriate recovery after brushing is lost which also causes the worsening of the brushing effect, when the length is too short. Accordingly, the length is determined to be from 15 to 60 mm.

The present invention is applicable to the in-line rolling for heat treating lines, plating lines, and multi-rolled mills other than four-high mills.

What is claimed is:

1. A method for cold rolling a strip in a rolling apparatus comprising at least a pair of work rolls and a pair of back up rolls, each of said back-up rolls being positioned to be in contact with a respective roll of said pair of work rolls and wherein suction means having at least one suction inlet are provided to remove particles generated by the contact between said rolls, comprising the steps of:

providing at least one rotatable brushing roll for at least one of said back up rolls which is positioned to contact and brush said at least one back up roll;

positioning said at least one suction inlet adjacent said at least one brushing roll;

providing suction control means adjacent said at least one suction inlet of said suction means, said suction control means being located in the vicinity where said at least one brushing roll and said at least one back up roll contact each other; and adjusting said suction control means to provide an airflow into said at least one suction inlet of at least five m/sec, said adjusting step including adjusting a size of an opening of said suction inlet.

2. A method of cold rolling a strip according to claim 1, wherein the brushing rolls rotate in a direction opposite to that of the associated back up rolls.

3. A method for cold rolling a strip according to claim 1, wherein the step of adjusting said suction control means further includes adjusting the position of said suction inlet relative to the contact area between said at least one brushing roll and said at least one back up roll.

4. A method for cold rolling a strip according to claim 1, wherein the brushing rolls rotate in the same direction as that of the associated back up rolls.

5. A method for cold rolling a strip according to claim 1, wherein said suction control means controls at least one of: contact pressure of said brushing roll against said back up roll; a position of said brushing roll relative to said suction inlet; the size of an opening into said suction inlet; and a suction pressure in said suction inlet.

6. A method for cold rolling a strip according to claim 1, wherein the rate of air flow into said suction inlets is at least 8 m/sec.

7. A method for cold rolling a strip according to claim 6, wherein the brushing rolls rotate in a direction opposite to that of the associated back up rolls.

8. A method for cold rolling a strip according to claim 1, wherein a plurality of brushing rolls are provided and positioned to respectively contact each of said work rolls and each of said back up rolls.

9. A method for cold rolling a strip according to claim 8, wherein the brushing rolls rotate in a direction opposite to that of the associated work rolls and the associated back up rolls.

* * * * *

UNITED STATES PATENT AND TRADEMARK OFFICE

CERTIFICATE OF CORRECTION

PATENT NO. : 5,081,857

DATED : January 21, 1992

INVENTOR(S) : NATSUI ET AL

It is certified that error appears in the above-identified patent and that said Letters Patent is hereby corrected as shown below:

Column 1, line 37, after the words "work roll", delete ",".

Column 4, line 44, replace "decreased" with --decreases--.

Column 5, line 46, after "changing to", insert --start--.

Column 5, line 54, delete "adjusting".

Title page -

Abstract, line 19, delete "and" (at the beginning of the line).

Signed and Sealed this

Seventh Day of September, 1993

Bruce Lehman

*Attest:*

BRUCE LEHMAN

*Attesting Officer*

*Commissioner of Patents and Trademarks*